US006186105B1

(12) United States Patent
Yonezawa

(10) Patent No.: US 6,186,105 B1
(45) Date of Patent: Feb. 13, 2001

(54) VARIABLE VALVE TIMING ARRANGEMENT FOR ENGINE

(75) Inventor: Minoru Yonezawa, Iwata (JP)

(73) Assignee: Yamaha Hatsudoki Kabushiki Kaisha, Iwata (JP)

( * ) Notice: Under 35 U.S.C. 154(b), the term of this patent shall be extended for 0 days.

(21) Appl. No.: 09/426,241

(22) Filed: Oct. 25, 1999

(30) Foreign Application Priority Data

Nov. 13, 1998 (JP) ..... 10-322731

(51) Int. Cl.[7] ..... F01L 1/344

(52) U.S. Cl. ..... 123/90.17; 123/90.34; 123/193.3; 123/196 M

(58) Field of Search ..... 123/90.15, 90.17, 123/90.31, 90.33, 90.34, 193.3, 196 M

(56) References Cited

U.S. PATENT DOCUMENTS 5,669,343 * 9/1997 Adachi ..... 123/90.17
5,799,631 * 9/1998 Nakamura ..... 123/90.17
5,954,019 * 9/1999 Yoshikawa et al. ..... 123/90.17
5,988,126 * 11/1999 Strauss et al. ..... 123/90.17
6,032,629 * 3/2000 Uchida ..... 123/90.34
6,035,817 * 3/2000 Uchida ..... 123/90.17
6,076,492 * 6/2000 Takahashi ..... 123/90.17

* cited by examiner

*Primary Examiner*—Weilun Lo
(74) *Attorney, Agent, or Firm*—Knobbe, Martens, Olson & Bear LLP

(57) ABSTRACT

An improved variable valve timing mechanism for an internal combustion engine wherein the variable valve timing mechanism includes a control valve mounted by a bearing cap for the cam shaft and specifically one end of the cam shaft. The bearing cap is fastened to the cylinder head by threaded fasteners that are disposed on opposite sides of a bearing surfaces a cam shaft in which at least one oil control groove is formed. Oil is supplied to this control groove by a valve element that is mounted in the bearing cap in spaced relation to the threaded fasteners.

7 Claims, 5 Drawing Sheets

VARIABLE VALVE TIMING ARRANGEMENT FOR ENGINE

BACKGROUND OF THE INVENTION

This invention relates to an internal combustion engine and more particularly to a variable valve timing arrangement for such engines and more specifically to a control valve arrangement for controlling the variable valve timing.

As is well known, many facets of engine design represent a compromise between obtaining high maximum power output and good running under low speed low load conditions. One of the factors that affect this performance is the valve timing of the engine.

The use of variable valve timing mechanisms facilitates the ability of the engine to run over a wider range of speeds and loads with optimum performance under each running condition.

Generally, variable valve timing mechanisms employ a hydraulic actuator that adjusts the phase angle between the driving element of the cam shaft and the cam shaft so as to change the valve timing relative to the crankshaft angle. These variable valve timing mechanisms can be used with either or both of the intake and/or exhaust cam shafts.

In order to provide the hydraulic force for actuating the variable valve timing mechanism, it has been the practice to employ the lubricant from the lubricating system of the engine. This lubricant is selectively applied to the variable valve timing mechanism by a control valve so as to accomplish the phase angle adjustment.

It has generally been the practice to mount the variable valve timing mechanism at the outboard end of the cam shaft and adjacent its forwardmost bearing. In order to cut down fluid losses and minimize the effects of leakage, it has been the practice to introduce the oil for the valve timing mechanism to the cam shaft through this forwardmost bearing surface. The control valve is then mounted in proximity to the bearing surface so as to control the application of the hydraulic pressure.

With these types of arrangements, it has been the practice to have the supply and discharge passages intersect the forwardmost bearing surface of the cam shaft and also to have the control valve mounted in proximity to the bearing surfaces. As a result, it has been necessary to employ a modified fastening arrangement for holding the forwardmost bearing cap in position. This presents some problems.

Specifically, it is desirable if the bearing cap is fastened to the engine body in axial alignment with the portion of the bearing surface in which the control valve communication ports are formed. However, this is the area where the variable valve timing control valve is normally positioned with most conventional applications. As a result, it is the practice to move the fasteners for the bearing cap to a location that is axially spaced from the bearing surface. This does not provide uniform loading nor good sealing.

It is, therefore, a principal object of this invention to provide an improved control valve and bearing arrangement for the variable valve timing arrangement of an internal combustion engine.

It is a further object of this invention to provide a bearing and valve arrangement for an engine wherein the number of bearing cap fasteners can be reduced and those fasteners juxtaposed to the associated bearing surfaces to improve sealing and hold down conditions.

SUMMARY OF THE INVENTION

This invention is adapted to be embodied in a variable valve timing mechanism for an internal combustion engine having a cam shaft with a bearing portion contiguous to one end thereof for journaling in an engine body at least in part by a bearing cap that is fixed to the engine body by fasteners that are disposed on opposite sides of the cam shaft bearing portion. A valve element is mounted in the bearing portion at a point that is spaced axially from the bearing surfaces of the cam shaft so as to be displaced from the fasteners. Passage means are formed in the bearing cap for delivering lubricant under pressure from the control valve to the bearing surface for distribution to a variable valve timing mechanism mounted on the cantilevered end of the cam shaft and which drives the cam shaft from the engine crankshaft.

DETAILED DESCRIPTION OF THE PREFERRED EMBODIMENT OF THE INVENTION

Figure 1:
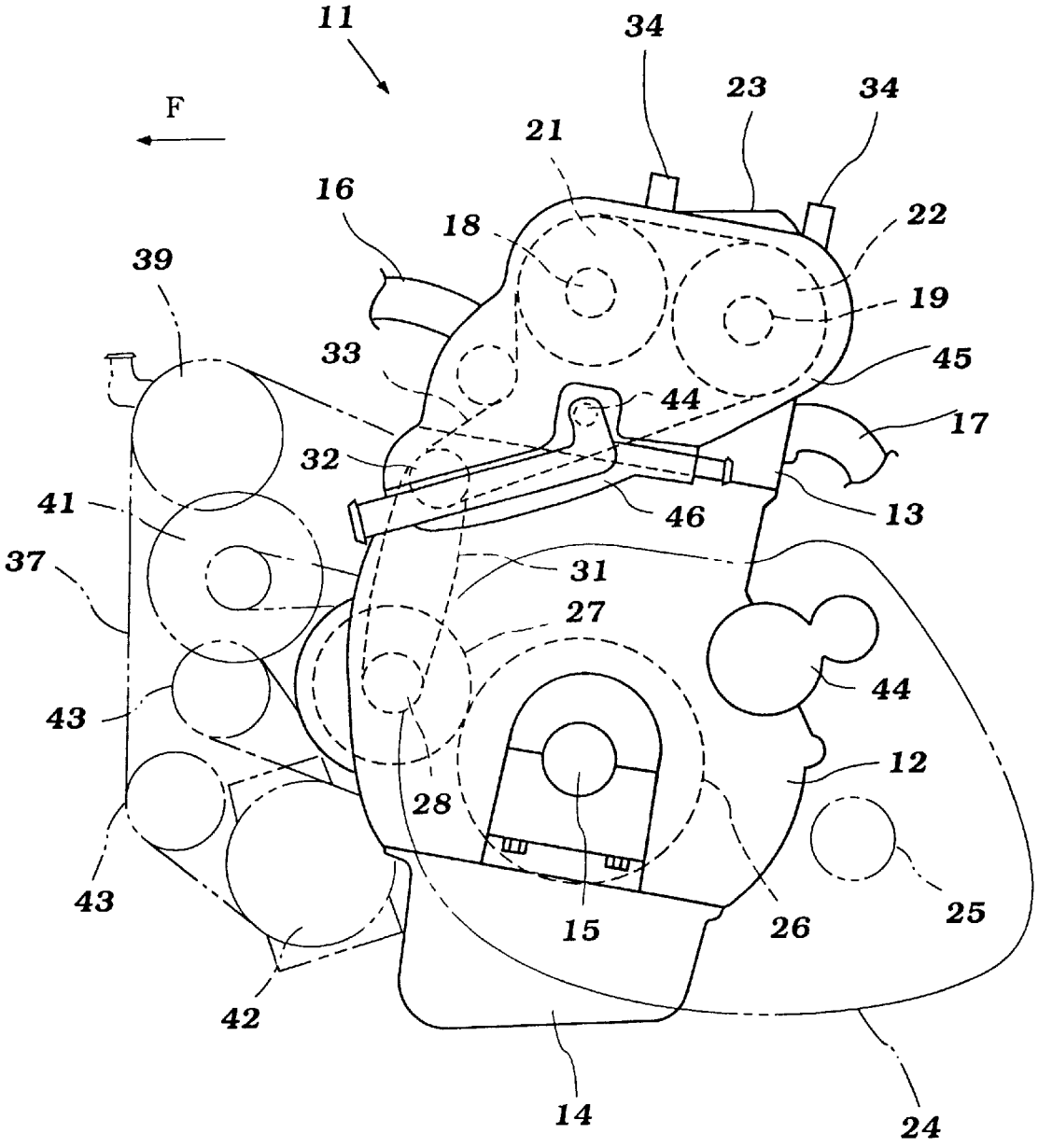
FIG. 1 is an end elevational view of an internal combustion engine constructed in accordance with an embodiment of the invention.
Figure 2:
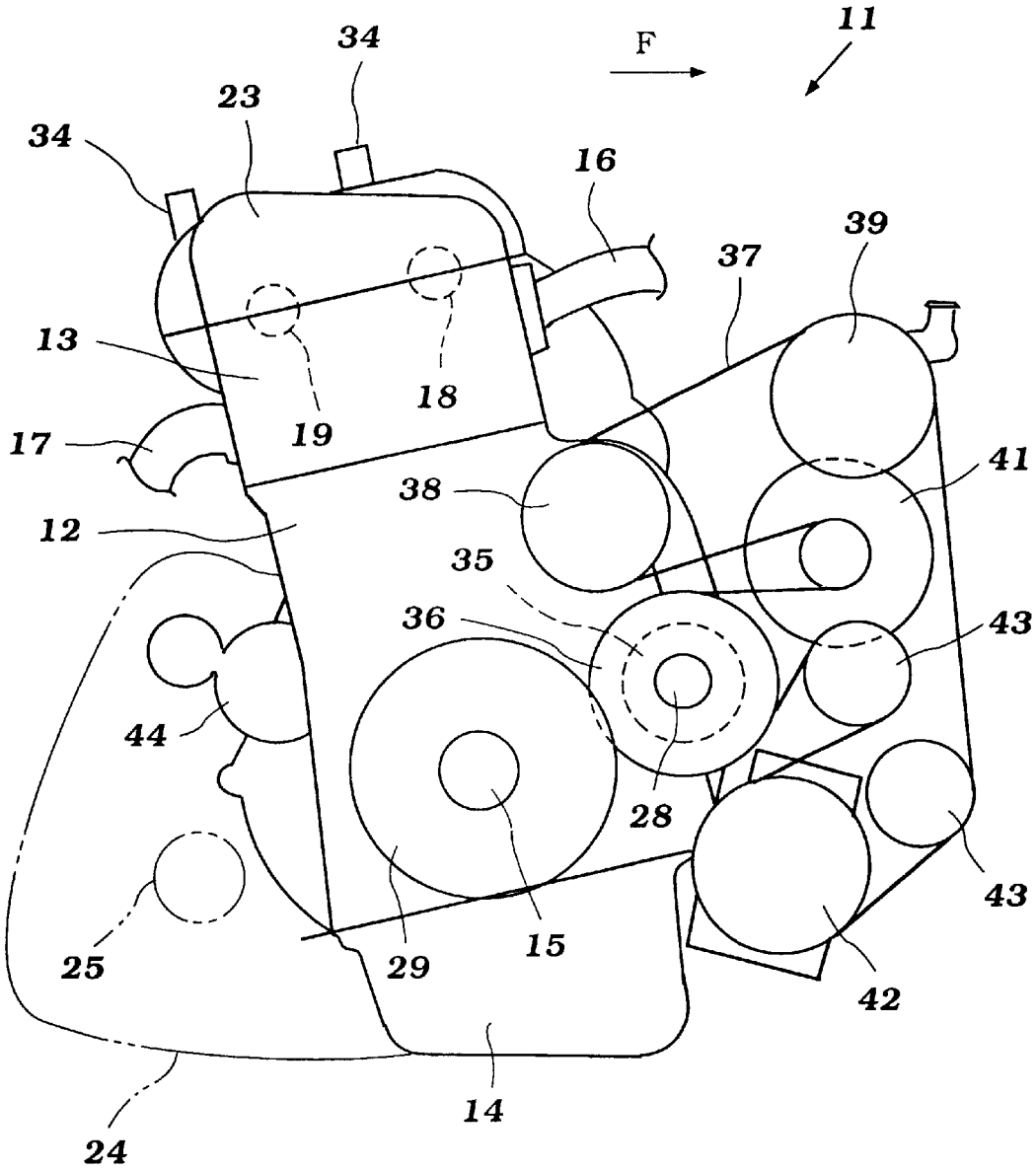
FIG. 2 is an end elevational view showing the opposite end of the engine from that depicted in FIG. 1.

Referring now in detail to the drawings and initially primarily to FIGS. 1 and 2, an internal combustion engine constructed in accordance with an embodiment of the invention is indicated generally by the reference numeral 11. In the illustrated embodiment, the engine 11 is of the inline type and has a number of inline cylinders. The engine 11 is particularly adapted for use in powering the motor vehicle wherein the engine 11 is placed transversely in the engine compartment for driving the vehicle through a suitable final drive to be described later.

The construction of the engine permits this transverse mounting of the engine 11 with the direction of forward motion of the vehicle being indicated by the reference numeral F. Although such an orientation and such a driving application is exemplary, it will be readily apparent to those skilled in the art the invention can be utilized with a wide variety of types of applications other than motor vehicles and also in motor vehicles applications where the engine 11 is not necessarily positioned transversely in the engine compartment of the vehicle.

Also, the particular number of cylinders and the orientation of them is not necessarily a critical feature of the invention. It will become readily apparent to those skilled in the art that the invention can be utilized with a wide variety of engine configurations.

The engine 11 is made up of an engine body that is comprised of three major external components. These comprise a cylinder block assembly 12, a cylinder head assembly 13 and a crankcase or oil pan member 14. The cylinder block assembly 12 forms one or more inline cylinder bores in which pistons reciprocate. Since the internal details of the engine form no part of the present invention, they are not illustrated. It will be readily apparent, however, how the invention can be employed with a wide variety of engine configurations, as already noted.

The aforenoted pistons reciprocate in the cylinder bores and are connected by connecting rods, which are also not shown, so as to drive a crankshaft 15. The crankshaft 15 rotates about a transversely disposed axis within a crankcase chamber formed by the oil pan 14 and a lower skirt or crank case forming portion of the cylinder block assembly 12.

The aforenoted pistons and their respective cylinder bores cooperate with recesses formed in the cylinder head 13 so as to form the combustion chambers of the engine. An intake charge is delivered to these combustion chambers through an intake manifold, indicated generally by the reference numeral 16. The delivered intake charge may comprise a pure air charge or an air/fuel charge depending upon the type of charge forming system employed for the engine. Since the charge forming system as well as the porting arrangement associated therewith, like other components which have not been described in detail, forms no part of the invention, it will not be described in further detail. It is believed that those skilled in the art will readily understand how the invention can be utilized with various types of induction and porting systems.

The charge which is delivered to the combustion chambers is fired in an appropriate manner and is then discharged through an exhaust system which includes an exhaust manifold 17 that is affixed to the cylinder head 13 on the side opposite to the intake manifold 16. Again, any suitable type of exhaust system and porting arrangement can be employed with the engine 11 including the exhaust manifold 17.

Intake and exhaust valves are mounted in the cylinder head assembly 13 for controlling the intake and exhaust flow in a generally known manner and are operated by means of a valve actuating mechanism which is comprised of an intake cam shaft 18 and an exhaust cam shaft 19. These cam shafts 18 and 19 are journaled in the cylinder head assembly 13 in a manner to be described and are driven at one half crankshaft speed by a suitable timing drive, also to be described shortly.

This timing drive includes a pair of variable valve timing mechanisms, indicated generally by the reference numerals 21 and 22 which may be of any known types so as to vary the phase angle between the intake and exhaust cam shafts 18 and 19 and the engine crankshaft 15. These variable valve timing mechanisms 21 and 22 are operated in a manner which will be described shortly.

Finally, the valve actuating mechanism including some of those components already described is covered by means of a cam cover 23 that is affixed to and forms a part of the cylinder head assembly 13 in a suitable member.

The associated vehicle is driven from the engine crankshaft 15 or another output shaft thereof through a transmission which is shown only in phantom and indicated generally by the reference numeral 24. This transmission 24 includes an output shaft 25 which is driven through a suitable transmission which may include a change speed mechanism of either a manual or an automatic type. Again, this component is not an important part of the invention and, for that reason, has not been illustrated in detail.

The mechanism for driving the cam shafts 18 and 19 including the variable valve timing mechanisms 21 and 22 will now be described initially by primary reference to FIGS. 1 and 2. The crankshaft 15 has a timing gear 26 affixed to it at an appropriate position along its length and which may be disposed adjacent one end of the engine such as the end shown in FIG. 1. However, this timing gear 26 need not be disposed at the absolute end of the crankshaft 15 but may be disposed inwardly at one or more throws thereof so as to maintain a short overall length for the engine.

This timing gear 26 is enmeshed with a driven timing gear 27 which drives a balancer shaft 28. The balancer shaft 28 can contain one or more balancing masses for partially balancing the crankshaft 15. In addition, a torsional damper 29 is affixed to the one end of the crankshaft 15 specifically the end shown in FIG. 2.

In addition to providing a balancer action, the balancer shaft 28 also includes a timing sprocket which drives a first flexible timing drive 31 which may comprise either a toothed belt or a chain. This drives a cam shaft driving shaft 32 which is journaled at an upper portion of the cylinder block 12 at one side thereof in a suitable manner.

The cam driving shaft 32 has a sprocket or toothed member fixed to an appropriate position adjacent one end of the engine (the end shown in FIG. 1) so as to drive a second flexible transmitter drive 33 which comprise either a chain or toothed belt. This flexible transmitter 33 is engaged with appropriate sprockets carried by the variable valve timing mechanisms 21 and 22 so as to drive the cam shafts 18 and 19 at one half of the speed of the crankshaft 15.

It should be noted that the speed reduction can be provided in several and different stages between the crankshaft 15, the balancer shaft 28, the cam driving shaft 32 and the variable valve timing mechanisms 21 and 22. Because of this multistage step down, the individual sprockets or gears can be maintained with a relatively small diameter to permit a compact engine construction.

The variable valve timing mechanisms 21 and 22 may, as have been noted, be of any known type and are hydraulically actuated so as to vary the valve timing in accordance with any desired control strategy. Control valves 34 are mounted in the cylinder head assembly 13 and specifically adjacent the timing drive for effecting this control. This mechanism and the mode of operation will be described shortly.

As may be best seen in FIG. 2, the balancer shaft 28 extends through one end of the engine and protrudes at the end shown in this Figure. At this point, the balancer shaft 28 may drive an oil pump 35 for supplying lubricant from a suitable lubricant system including the oil pan 14 to the various components of the engine as well as the VVT control valves 34 for engine operation. Also affixed to the balancer shaft 28 at this end of the engine, is an accessory drive pulley 36.

This accessory drive pulley 36 drives a flexible transmitter 37 for driving a plurality of engine accessories. These may include, by way of example, a coolant pump 38 for circulating liquid coolant through the cooling jackets of the engine 11, as will be described in part in more detail later. In addition, there are driven a further oil pump 39, an alternator 41, and an air conditioner pulley 42. In order to provide this serpentine drive for the accessories, there are also provided idler pulleys 43 one of which may be adjustable so as to adjust the tension in the drive belt 37.

A starter motor 44 is mounted on a side of the cylinder block and cooperates with a suitable starter gear formed on the crankshaft 15 or a flywheel associated therewith including the damper 29 for electrical starting of the engine.

As seen in FIG. 1, the face of the engine and specifically of the cylinder head 13 adjacent the flexible transmitter 33 is formed with the opening 44 via which coolant may be discharged from the engine body and specifically the cylinder block 12 and cylinder head 13 and cooling jackets thereof . It will be seen that this opening 44 lies in an area circumscribed by the flexible transmitter 33. A cover 45 is provided which is affixed to the cylinder head 13 and valve cover 23 at this end of the engine and which covers basically the variable valve timing drives 21 and 22 and a major portion of the length of the flexible transmitter 33. However, the area overlying the water outlet opening 44 is covered by a coolant manifold member, indicated generally by the reference numeral 46, and which has a face that is directly engaged with the adjacent surface of the cylinder head 13. This construction is described in more detail in my copending application entitled "Engine Coolant Manifold", Ser. No. 09/426,337, filed Oct. 25, 1999 and assigned to the Assignee hereof.

The invention deals primarily with both the journaling for the intake and exhaust cam shafts 18 and 19 and the way in which hydraulic fluid and specifically engine lubricant is delivered to the variable valve timing mechanisms 21 and 22 for their actuation by the control valves 34. This structure will be described in detail now by primary reference to FIGS. 3–5.

As may be best seen in these figures, each of the cam shafts 18 and 19 has respective cam lobes 47 that cooperate with a respective actuating mechanism such as a thimble tappet for operating the intake and exhaust valves of an associated cylinder. The described construction relates to a four valve per cylinder engine, but it should be readily apparent that it may be employed in conjunction with engines having other numbers of valves per cylinder.

Also, only the lobs 47 associated with the end cylinder are illustrated because it is this area of the support for the cam shafts 18 and 19 with which the invention resides. The area between the lobes 47 of each cam shaft is formed with a bearing surface and a further bearing surface 48 extends forwardly therefrom up to and terminating at the respective variable valve timing mechanism 21 or 22. It should be noted that these forward bearing portions are separated in part by a thrust shoulder 49.

Figure 3:
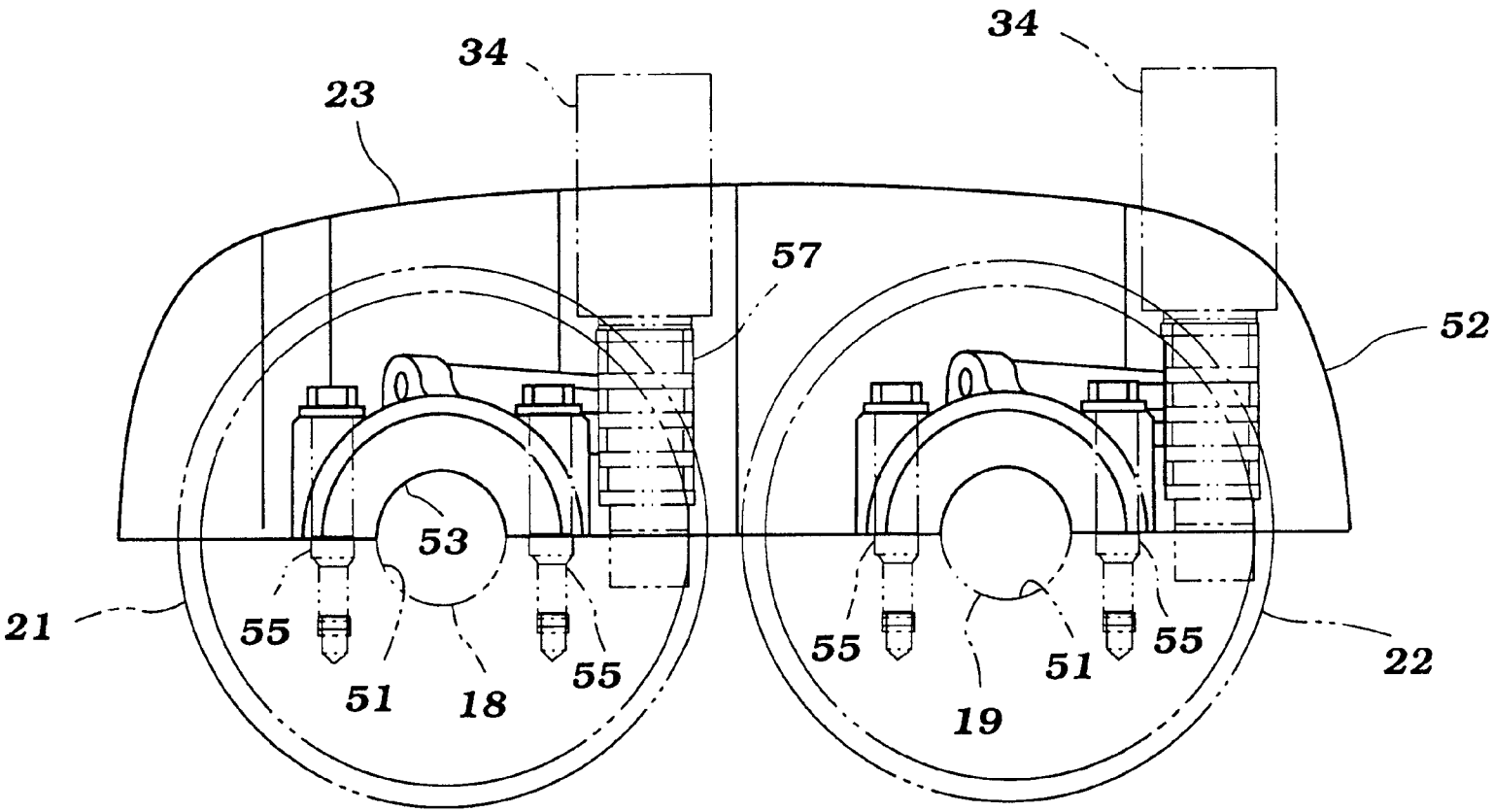
FIG. 3 is a front elevational view looking generally in the same direction as FIG. 1 but on an enlarged scale and shows the bearing cap arrangement for the front portions of the intake and exhaust cam shaft.
Figure 4:
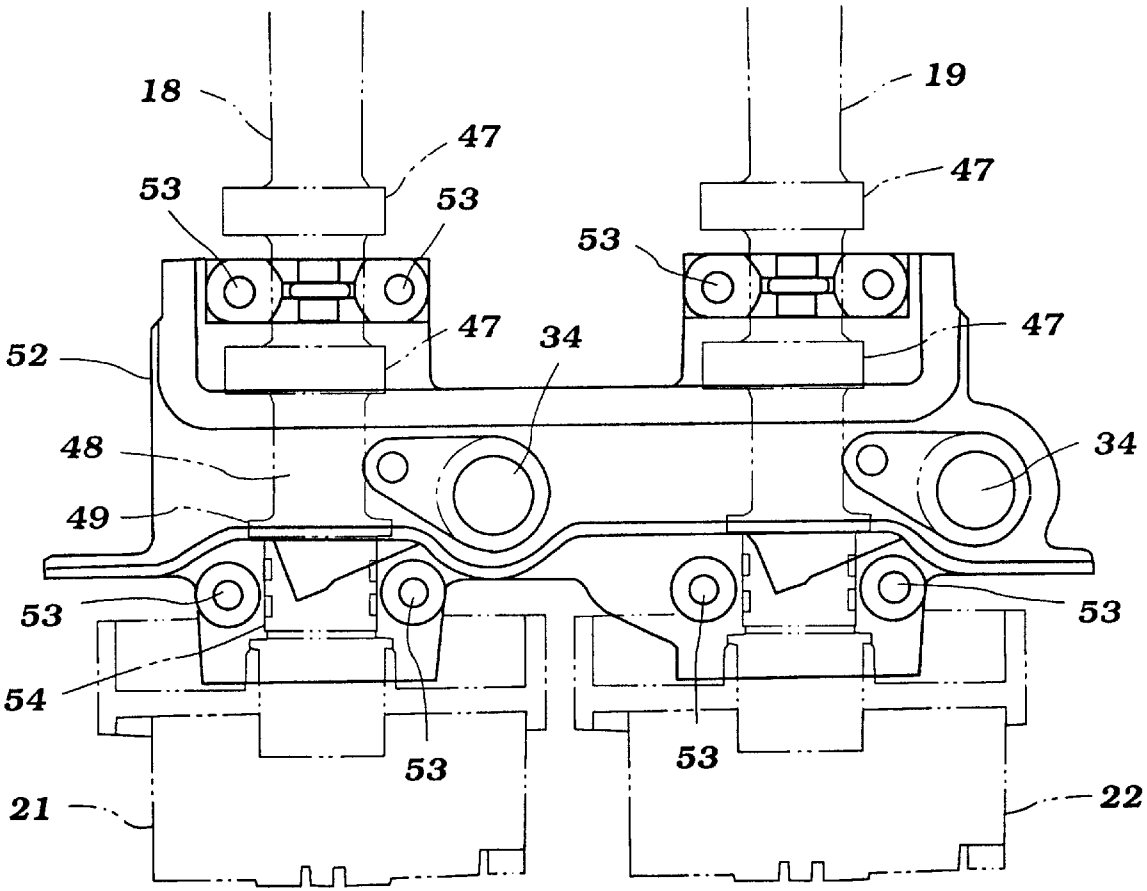
FIG. 4 is a top plan view of the components shown in FIG. 3.

The cylinder head member 13 is formed with a machined bearing surface, which appears partially in FIG. 3 and is indicated by the reference numeral 51. This surface 51 forms a half of the cylinder head bearing surface for these cam shaft bearing surfaces 48. The remaining bearing half is formed by a bearing cap 52 that is affixed to the cylinder head member and thus forms a part of the cylinder head assembly 13. This bearing cap 52 has complimentary bearing surfaces 53 which cooperate with the cylinder head bearing surfaces 51 for journaling the cam shafts 18 and 19 in the cylinder head assembly 13.

The bearing cap 52 has spaced openings 53 that receive threaded fasteners so as to detachably affix them to the main cylinder head member to complete the assembly 13. It should be noted that the openings 53 are formed in direct axial alignment with a portion 54 of the bearing surface 51 which is juxtaposed to the variable valve timing mechanisms 21 and 22. The fasteners are shown in FIG. 3 and are identified by the reference numerals 55.

Although the variable valve timing mechanisms 21 and 22 may be of any known type, they define a pair of fluid chambers to which fluid is distributed by the valve mechanisms 34 so as to shift the phase angle between the crankshaft 15 and the respective cam shafts 18 and 19, as aforenoted. It will be seen that the valves 34 are mounted in a mounting portion 56 of the bearing cap 52. The valve actuating mechanism 53 includes solenoid actuator that protrudes upwardly from the bearing member 52 and through the cam cover 23 parallel to the fastener openings 53. This actuates a valve spool 57 which is slidably supported within the bearing member 52.

Figure 5:
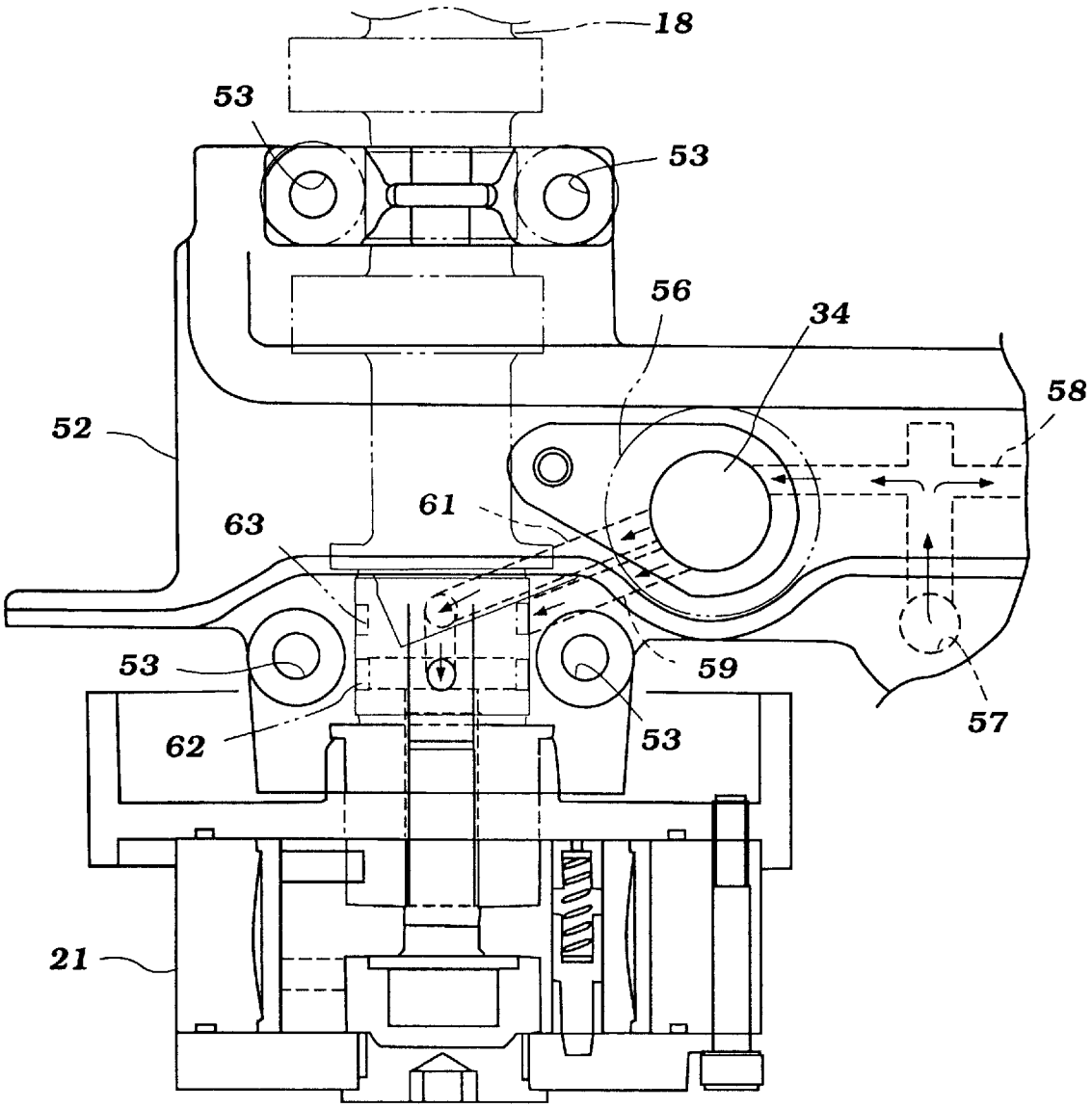
FIG. 5 is a view looking in the same direction as FIG. 4 but shows the fluid flow passages for delivering and returning oil to the variable valve timing mechanism associated with the intake cam shaft.

The cylinder head member 13 is formed with a main oil gallery passages 57 that extends vertically upwardly and which intersects a cross drilled passageway 58 that is formed in the bearing cap 52. This cross drilled passageway terminates the end proximity to valve spool 57 so as to control the pressurization of either of a pair of supply passages 59 and 61 which, in turn, are drilled at an angle as seen in FIG. 5 so as to clear the fastener openings 53 and the fasteners 55 received therein.

These passageways intersect respective distributor grooves 62 and 63 formed in the outer periphery of the cam shaft bearing portion 54 so as to selectively pressurize one side or the other of the variable valve timing mechanism 21 so as to effect its actuation.

Thus, it should be apparent from this description that the positioning of the valve members 34 in the bearing cap 52 permits the fastener openings 53 to be disposed centrally on the respective bearing surfaces of the cam shaft and immediately adjacent the grooves 62 and 63 so as to provide not only good sealing but the appropriate hold down pressure. Thus, the previously proposed bearing arrangements which space the fasteners from the supply surfaces is avoided.

Of course, the foregoing description is that of a preferred embodiment of the invention, and various changes and modifications may be made without departing from the spirit and scope of the invention, as defined by the appended claims.

What is claimed is:

1. A variable valve timing mechanism for an internal combustion engine having a cam shaft having a bearing portion at one end thereof for journaling in an engine body at least in part by a bearing cap fixed to said engine body by threaded fasteners disposed on opposite sides of said cam shaft bearing portion, a variable valve timing mechanism associated with said one end of said cam shaft for driving said cam shaft from an engine crankshaft and for varying the phase angle between said cam shaft and the engine crankshaft, said bearing portion being formed with at least one circumferential groove for receiving hydraulic fluid for actuating said variable valve timing mechanism, and a valve element mounted by said bearing cap for controlling the flow of fluid therethrough to said groove, said valve element being spaced relative to said threaded fasteners in the direction of the axis of said cam shaft.

2. A variable valve timing mechanism as set forth in claim 1, wherein the bearing cap has axially spaced bearing surfaces engaged with axially spaced bearing portions of the cam shaft and pairs of threaded fasteners for fixing said bearing cap to the engine body.

3. A variable valve timing mechanism as set forth in claim 2, wherein the control valve is disposed axially between the pairs of fasteners.

4. A variable valve timing mechanism as set forth in claim 3, wherein passages are formed in the bearing cap extending diagonally from the control valve to the cam shaft groove and passing between the threaded fasteners at the one end of the cam shaft.

5. A variable valve timing mechanism as set forth in claim 1, wherein the control valve comprises a valve spool supported in the bearing cap for reciprocation along an axis that is parallel to the axes of the threaded fasteners.

6. A variable valve timing mechanism as set forth in claim 1, wherein a pair of cam shafts are journaled by the bearing cap in the engine.

7. A variable valve timing mechanism as set forth in claim 6, wherein each of the cam shafts is driven by a variable valve timing mechanism each of which is controlled by a respective control valve mounted in the bearing cap.

* * * * *